US012514330B1

(12) United States Patent
Sullivent, Jr.

(10) Patent No.: US 12,514,330 B1
(45) Date of Patent: Jan. 6, 2026

(54) ERGONOMIC SHOE

(71) Applicant: Thomas Jackson Sullivent, Jr., Jenks, OK (US)

(72) Inventor: Thomas Jackson Sullivent, Jr., Jenks, OK (US)

( * ) Notice: Subject to any disclaimer, the term of this patent is extended or adjusted under 35 U.S.C. 154(b) by 0 days.

(21) Appl. No.: 18/531,496

(22) Filed: Dec. 6, 2023

(51) Int. Cl.
*A43B 13/14* (2006.01)

(52) U.S. Cl.
CPC ..... *A43B 13/14* (2013.01)

(58) Field of Classification Search
CPC ..... A43B 13/14
See application file for complete search history.

(56) References Cited

U.S. PATENT DOCUMENTS 1,117,246 A 11/1914 Roese, Jr.
1,455,887 A 5/1923 Salisbury
1,636,905 A 7/1927 Falor et al.
1,731,225 A 10/1929 Schneider
2,021,067 A 11/1935 Johnson
2,607,132 A 8/1952 Wikler
3,785,068 A * 1/1974 Bretschneider ..... A43B 7/28 36/11.5
3,964,181 A * 6/1976 Holcombe, Jr. ..... A43B 13/145 36/25 R
4,030,213 A * 6/1977 Daswick ..... A43B 13/12 36/114
4,041,619 A 8/1977 Sapper
4,672,754 A * 6/1987 Ehrlich ..... A43B 13/12 36/31
4,939,853 A 7/1990 Farbman
5,079,856 A * 1/1992 Truelsen ..... A43B 21/26 36/28
6,158,151 A * 12/2000 Won ..... A43B 7/141 36/103
7,062,866 B2 6/2006 Bussler
10,779,611 B2 9/2020 Jackinsky
2013/0185955 A1* 7/2013 Cheng ..... A43B 7/145 36/28
2019/0082781 A1* 3/2019 Iuchi ..... A43B 13/026
2020/0077740 A1* 3/2020 Chiu ..... A43B 13/187
(Continued)

FOREIGN PATENT DOCUMENTS

CN 201414469 3/2010
GB 302384 12/1928
WO WO2021234557 A3 11/2021

*Primary Examiner* — Bao-Thieu L Nguyen
(74) *Attorney, Agent, or Firm* — James F. Lea, III; Gable Gotwals

(57) ABSTRACT

A shoe having a zero drop heel and ergonomic toe box and a form for making the shoe. A sole defines a ball contact area and a heel contact area. Sole thickness may be greater at the ball contact area. A sole drop area adjacent to a heel front side accommodates a foot received in a sink of the heel formed in a heel top surface. A portion of sole inside surface between an inside joint line and a toe-end is parallel to a longitudinal axis for facilitating accommodation of a wearer's big toe. A ball contacting surface and a heel contacting surface support a wearer's foot. The contacting surfaces are the same as or adjacent to a sole upper surface. Distance between ball contacting surface and sole lower surface is approximately equal to distance between heel contacting surface and heel bottom surface, which facilitates "zero drop".

18 Claims, 6 Drawing Sheets

(56) References Cited

U.S. PATENT DOCUMENTS

| | | | | |
|---|---|---|---|---|
| 2022/0183419 | A1* | 6/2022 | Pham | A43B 17/006 |
| 2022/0369765 | A1* | 11/2022 | Behnamian | A61H 15/00 |
| 2023/0276893 | A1* | 9/2023 | Mittal | A43B 13/141 36/97 |

* cited by examiner

ERGONOMIC SHOE

FIELD OF THE INVENTION

The present invention relates to shoes. More particularly, the invention relates to ergonomic shoes having an improved toe box and facilitating a zero drop while retaining a conventional appearance.

BACKGROUND OF THE INVENTION

A primary cause of foot pain may be attributed to foot weakness and injuries caused by shoes. In addition, many people have knee problems, hip problems, back problems and neck problems directly caused by their shoes. An elevated shoe heel that causes an elevation increase in the heel of a wearer's foot with respect to the ball of a wearer's foot will cause a person to make adjustments while standing and walking. These adjustments can cause pain and possibly injuries. Narrow toe boxes of typical shoes squeeze the toes of a wearer. When the big toe is pushed inward, a bunion may occur wherein the joint behind the big toe is forced outward because the big toe has been forced inward. Many times this condition is permanent and can affect a person's mobility.

SUMMARY OF THE INVENTION

The primary purpose of the shoe of the invention is to maintain foot health.

In one aspect, the shoe of the invention is designed to avoid injuring the feet and to allow a person to stand flat so that their body can remain in the most comfortable position possible without requiring any self-adjusting.

The shoe of the invention has two primary attributes that distinguish it from prior art formal dress shoes: (1) zero drop heel and sole; (2) wide toe box.

Heel and Sole

The shoe of the invention may be built using a last. The shoe of the invention is designed so that a wearer's foot has a minimal or no difference between elevation of the wearer's heel with respect to the ground, and the elevation of the wearer's ball of the foot with respect to the ground. In other words, the shoe of the invention provides what may be referred to as "zero drop". The shoe construction disguises the fact that there is no change in elevation in the heel of the shoe. In particular, the shoe of the invention utilizes the following features to disguise the "zero drop" features of the shoe of the invention and to create an appearance that approximates that of a conventional shoe.

In one embodiment, the sole is thicker in the front and is of a reduced thickness in the middle, i.e., shank or "waist" portion of shoe as the sole approaches the heel. Also, the curvature of the sole counteracts the small heel on the shoe. The varying thickness of the sole, together with the curvature of the sole, facilitates a foot orientation of a wearer such that a distance from the heel of the foot to the ground is approximately the same as a distance from the ball of their foot to the ground. In one embodiment, the sole maintains a consistent thickness over its length. The sole is shaped to form a curved area adjacent to the heel of the shoe. In another embodiment, the thickness of the sole may be a first thickness at ball a contact area and may be tapered to a second thickness in front of the heel of the shoe. Additionally, the heel of the shoe may be shaped to provide sink, e.g., 10-18 mm, or 12-15 mm or approximately 13 mm depression, to lower the heel of a wearer. It is believed that, providing a zero or minimal elevational change between the ball of the foot and the heel, referred to herein as "zero drop", is important. By providing a zero drop construction of the shoe of the invention, a foot is not pitched forward in the shoe, which eliminates a need of a wearer to adjust their body by slightly bowing their back, which may create tightness in the low back area.

Wide Toe Box

A second attribute of the shoe of the invention relates to a wide toe box. The human foot is not symmetrical. The inside of a foot has a big toe that extends further forward than a little toe on the outside of a wearer's foot. Nevertheless, most dress shoes are made so that an individual shoe has a somewhat symmetrical appearance. As a result, most dress shoes curve inwardly on the outside. The outside curve may correspond somewhat to a normal human foot, although most dress shoes curve in too drastically to the point. Dress shoes typically also curve inward on the inside of the foot, i.e., at a location adjacent to a wearer's big toe. A conventional dress shoe possesses an inside or toe side curve that deviates approximately 20° from a longitudinal parallel when measured from the inside joint line. However, a human foot does not naturally curve inwardly at this location.

In one embodiment, the shoe of the invention does not curve inward at either an outside curve location adjacent to a wearer's little toe on the outside of the foot or at an inside curve location on the inside or big toe edge of the foot. Instead, the toe box of the shoe of the invention follows the natural shape of a foot and does not press the big or little toe inward. In a preferred embodiment, a big toe side curve portion deviates 0° from a longitudinal parallel when measured from the inside joint line. Once the shoe of the invention has followed the natural curvature of the foot past the big toe area and past the little toe area, the shape of the shoe begins a gradual swoop at the front from the tip of the big toe over to the tip of the small toe.

In greater detail, the shoe of the invention has a sole having an upper surface, a lower surface, a heel end, and a toe-end. The sole defines a thickness between the upper surface and the lower surface, and defines a ball contact area and a heel contact area. In one embodiment, thickness of the sole is greater at the ball contact area than at the heel contact area. In one embodiment, the sole defines a drop area adjacent to the front side of the heel, the drop area for accommodating a foot of a wear received in the sink of the heel. In one embodiment, the sole further defines an inside surface, an outside surface, an inside joint line, an outside joint line and a longitudinal axis and a portion of the inside surface of the sole between the inside joint line and the toe-end is parallel to the longitudinal axis for facilitating non-impingement of the upper with a big toe of a wearer.

An upper is affixed to the upper surface of the sole and a heel is affixed to the lower surface of the sole proximate the heel end of the sole. The heel has a front side, a top surface and a bottom surface. The top surface defines a sink for receiving the sole proximate the heel end of the sole, wherein a center of the sink in the top surface of the heel is lower than the top surface of the heel adjacent a perimeter of the heel.

A ball contacting surface supports a foot of a wearer. The ball contacting surface is the same as or adjacent to the upper surface of the sole at the ball contact area.

A heel contacting surface supports a foot of a wearer. The heel contacting surface is the same as or adjacent to the upper surface of the sole at the heel contact area.

A distance between the ball contacting surface and the lower surface of the sole is approximately equal to a distance between the heel contacting surface and the bottom surface of the heel, which forms a "zero drop".

A form of the invention approximates a shape of an inside of a shoe to be made from the form. The form has a back part, a forepart separated by a shank, and a bottom surface. The back part has a heel end, a seat, and an instep. The forepart defines a toe end, in inside joint line, an outside joint line, a toe edge, an outside, and a seat.

The form defines a longitudinal axis that bisects the back part and runs from the toe end to the heel end. The form further defines a feathered edge proximate the bottom surface of the form, wherein the feathered edge runs from the toe end to the heel end.

A heel lift defines a distance from a center of the seat to the bottom surface.

In one embodiment, a portion of the edge of the sole between the inside joint line and the toe end is parallel to the longitudinal axis.

DETAILED DESCRIPTION OF THE PREFERRED EMBODIMENTS

Figure 1:
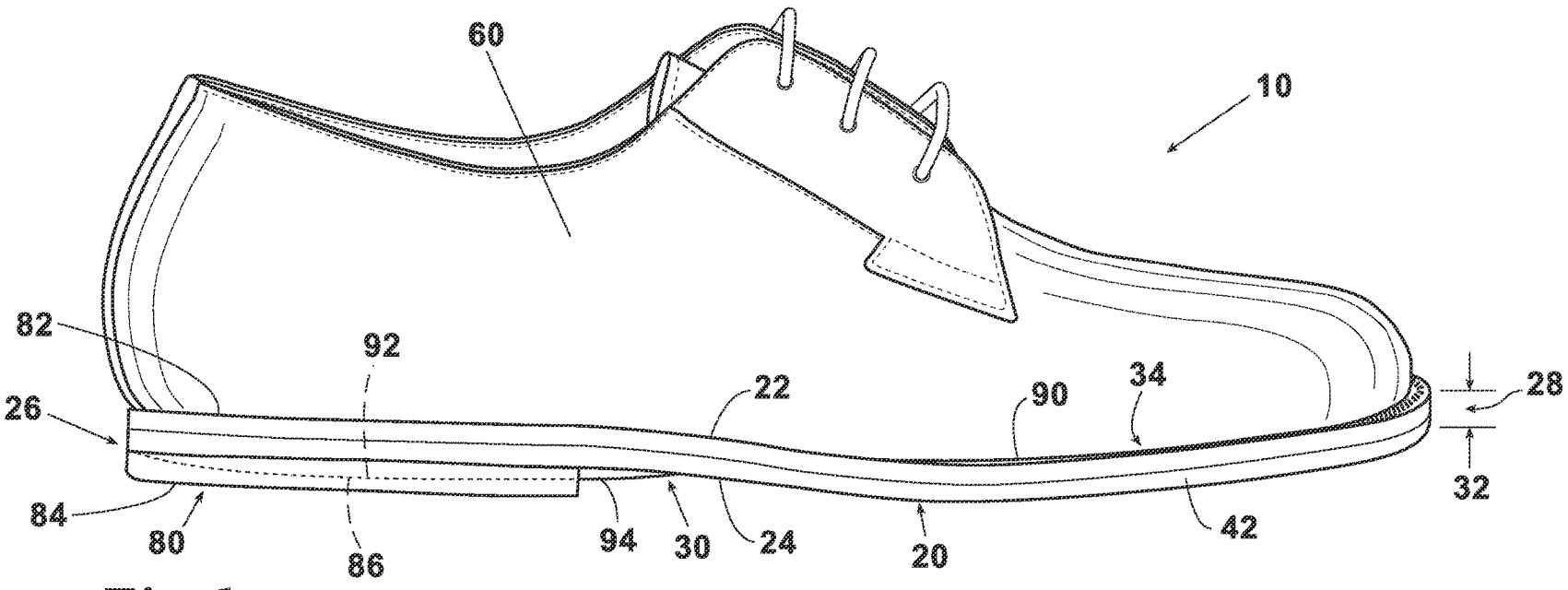
FIG. 1 is a partial cut-away elevational view of a shoe.
Figure 2:
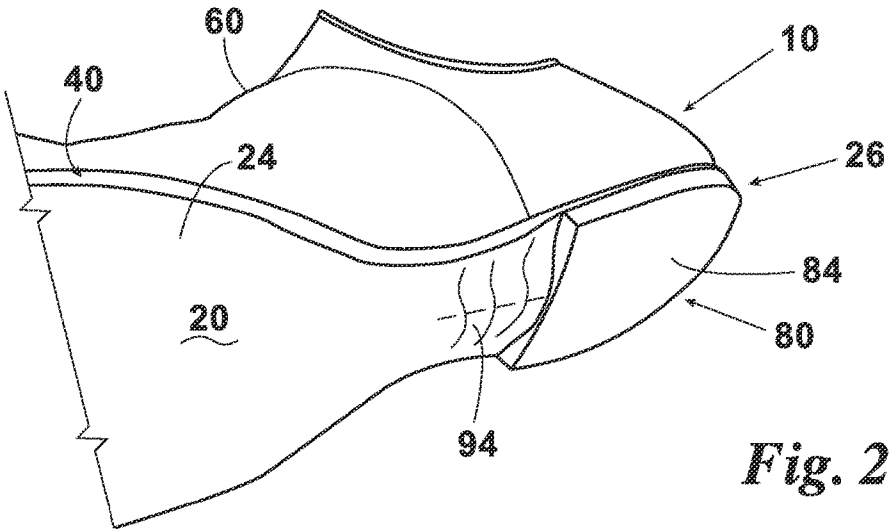
FIG. 2 is a bottom perspective view of the shoe of FIG. 1.
Figure 3:
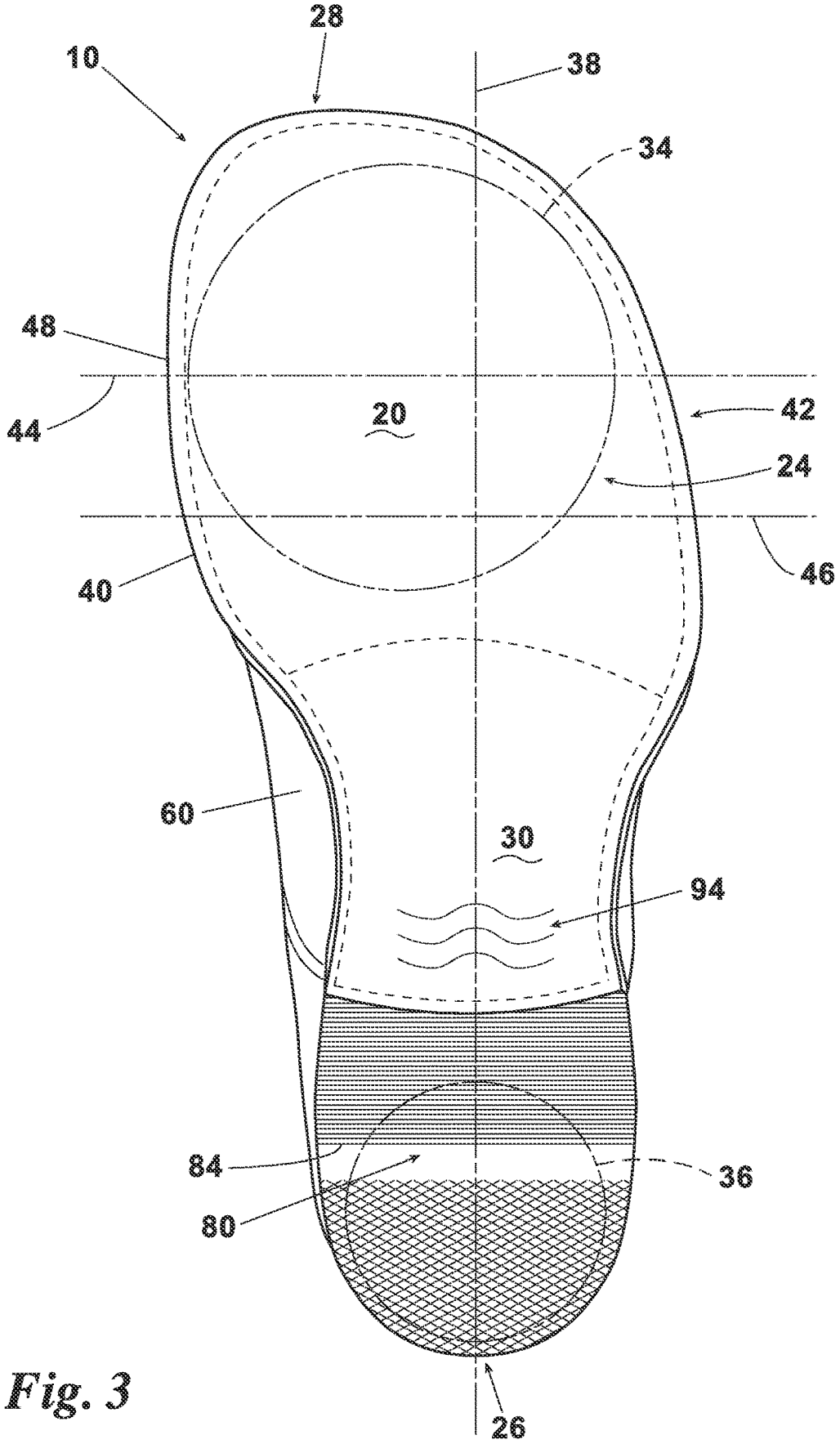
FIG. 3 is a bottom view of the shoe FIG. 1.
Figure 4:
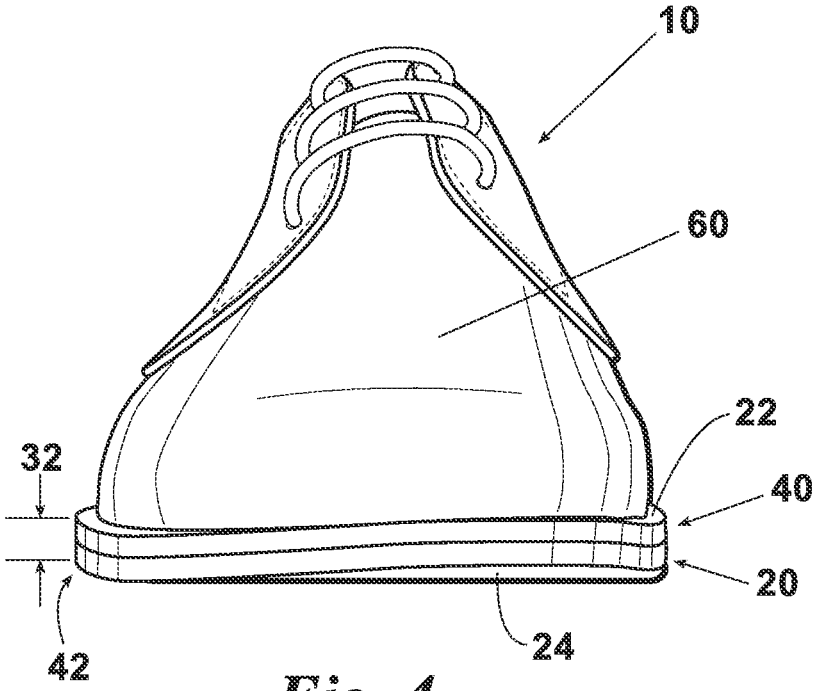
FIG. 4 is a front view of the shoe of FIG. 1.
Figure 6:
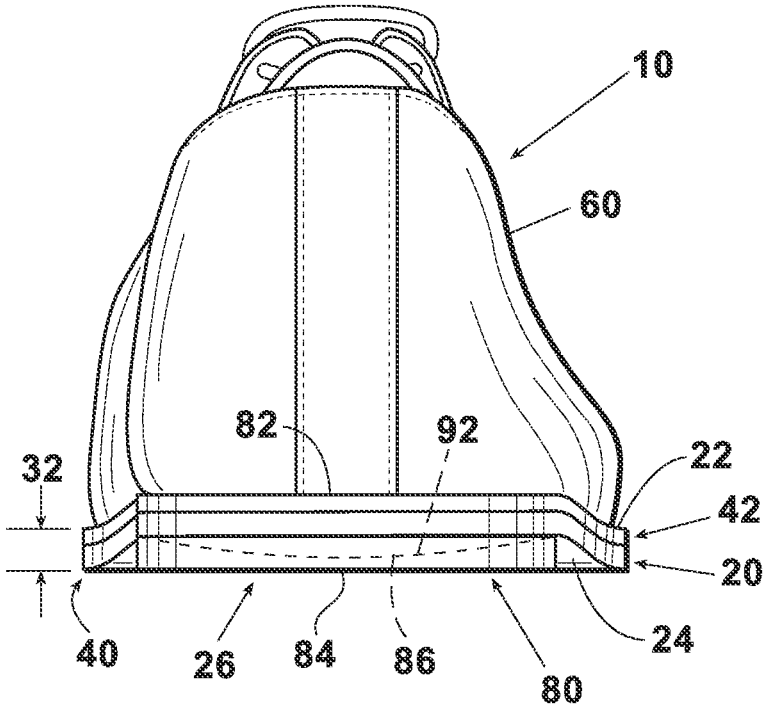
FIG. 6 is a rear view of the shoe of FIG. 1.
Figure 5:
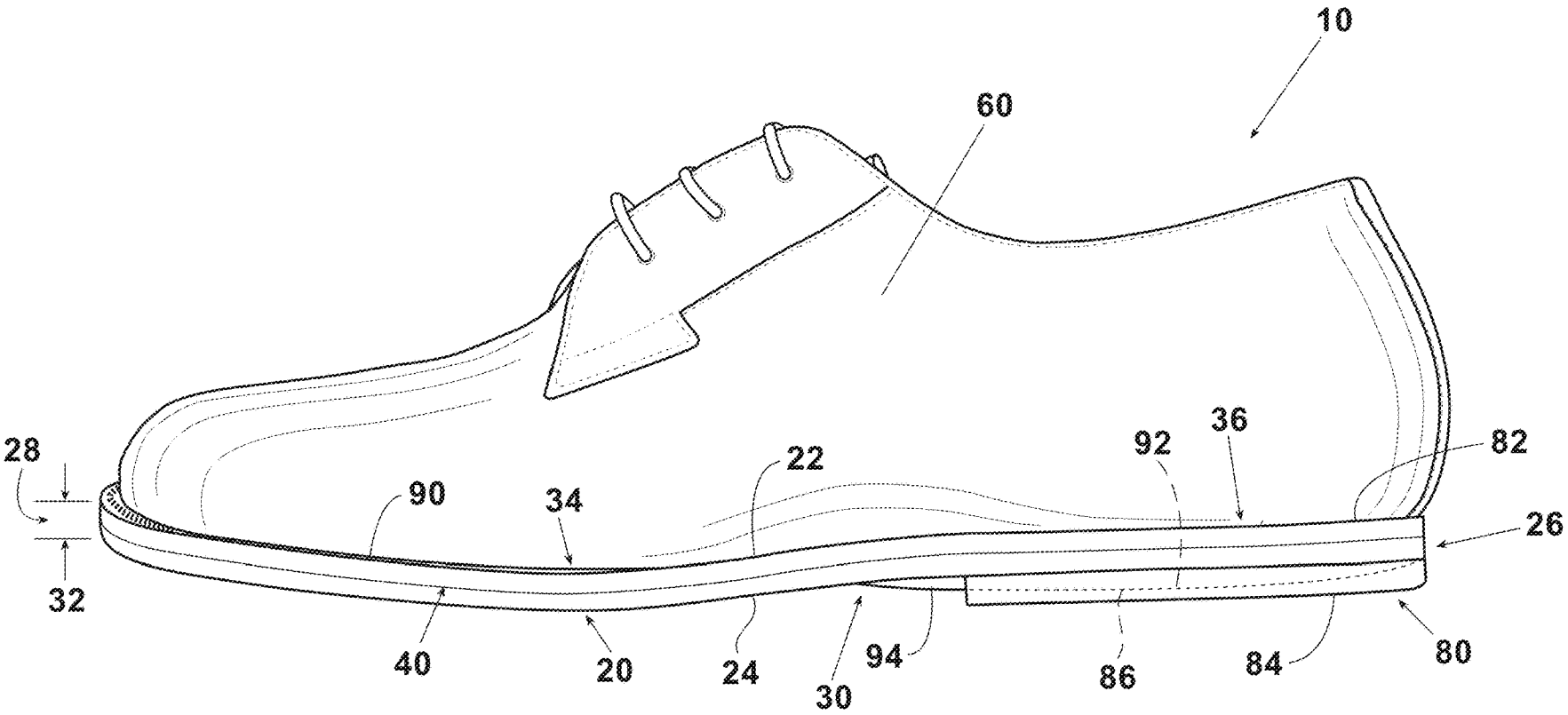
FIG. 5 is a left side view of the shoe of FIG. 1.
Figure 7:
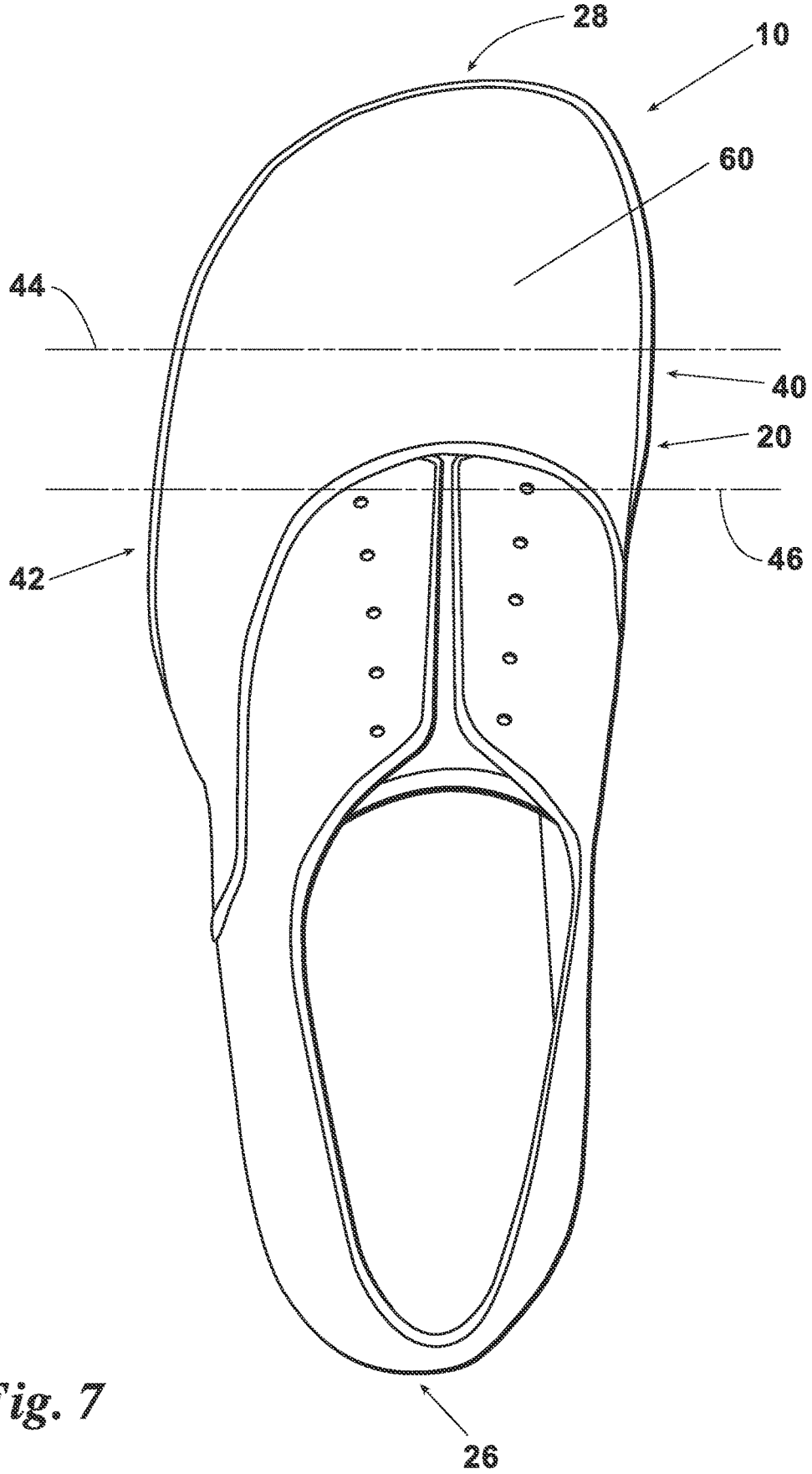
FIG. 7 is a top view of the shoe of FIG. 1.

Referring now to FIGS. 1-7, shown is a shoe designated generally 10. Shoe 10 includes sole 20. Sole 20 has an upper surface 22, a lower surface 24, a heel end 26, a toe end 28, and a shank or waist portion 30 between heel end 24 and toe end 28. Sole 20 defines a thickness 32 between upper surface 22 and lower surface 24. Sole 20 defines a ball contact area 34 (FIG. 3) and heel contact area 36 (FIG. 3). In one embodiment, thickness 32 of sole 20 is greater at ball contact area 34 than at heel contact area 36.

Sole 20 defines longitudinal axis 38 (FIG. 3) that bisects a portion of shoe 10 adjacent to heel end 26, e.g., bisects heel 80, and runs between heel end 26 and toe end 28. Sole 20 additionally defines inside surface 40, outside surface 42, inside joint line 44, and outside joint line 46. In one embodiment, parallel portion 48 (FIG. 3) of inside surface 40 of sole 20 between inside joint line 44 and toe end 28 is parallel to longitudinal axis 38 for facilitating non-impingement of upper 60 with a big toe of a wearer. Upper 60 is affixed to upper surface 22 of sole 20.

Shoe 10 additionally includes heel 80. Heel 80 is affixed to lower surface 24 of sole 20 proximate to heel end 26 of sole 20. Heel 80 has upper side 82 and lower side 84. In one embodiment, upper side 82 defines sink 86 (FIGS. 1, 5, 6) for receiving sole 20 proximate to heel end 24 of sole 20.

Ball contacting surface 90 (FIGS. 1, 5) is for supporting a foot of a wearer. Ball contacting surface 90 is the same as or is adjacent to upper surface 22 of sole 20 in ball contact area 34 of sole 20.

Heel contacting surface 92 (FIGS. 1, 5) is provided for supporting a foot of a wearer. Heel contacting surface 92 is the same as or is adjacent to upper surface 22 of sole 20 in heel contact area 36 of sole 20. In one embodiment, the distance between ball contacting surface 90 and lower surface 24 of sole 20 is approximately equal to a distance between heel contacting surface 92 and lower side 84 of heel 80. An example range of the approximately equal distance is-⅛" to ¼" wherein a negative value indicates that the distance between ball contacting surface 90 and lower surface 24 of sole 20 is greater than the distance between heel contacting surface 92 and lower side 84 of heel 80. A positive value indicates that the distance between ball contacting surface 90 and lower surface 24 of sole 20 is less than the distance between heel contacting surface 92 and lower side 84 of heel 80. Another preferred range is-1/16" to 3/16", more preferred range is zero to ⅛", and a most preferred distance is 0.

Sole 20 may be shaped to form drop area 94 (FIGS. 1, 2, 5) for accommodating a foot of a wearer whose heel is supported on said heel contacting surface 92 in sink 86 within heel 80. In one embodiment, drop area 94 accommodates a foot contacting surface that smoothly adjoins heel contacting surface 92 for receiving a foot of a wearer.

Figure 9:
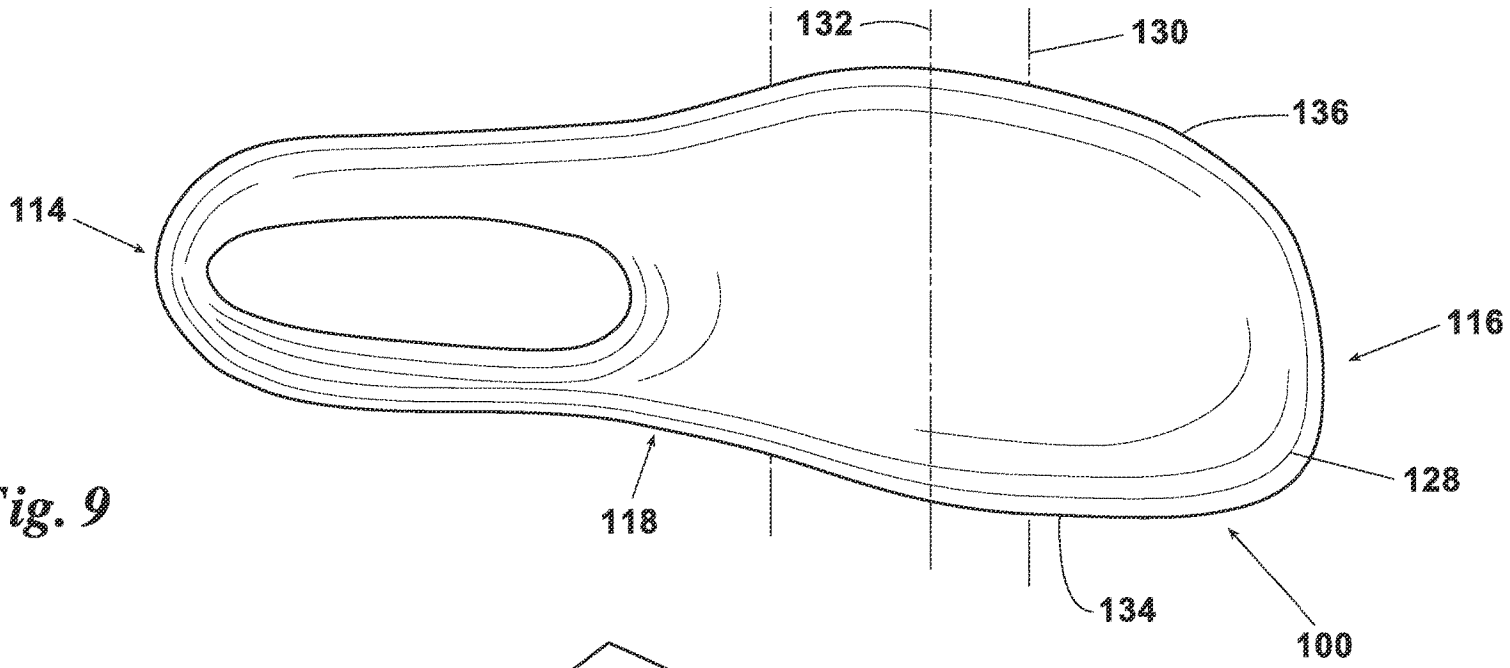
FIG. 9 is a plan view of a last for building the shoe of FIG. 1.
Figure 8:
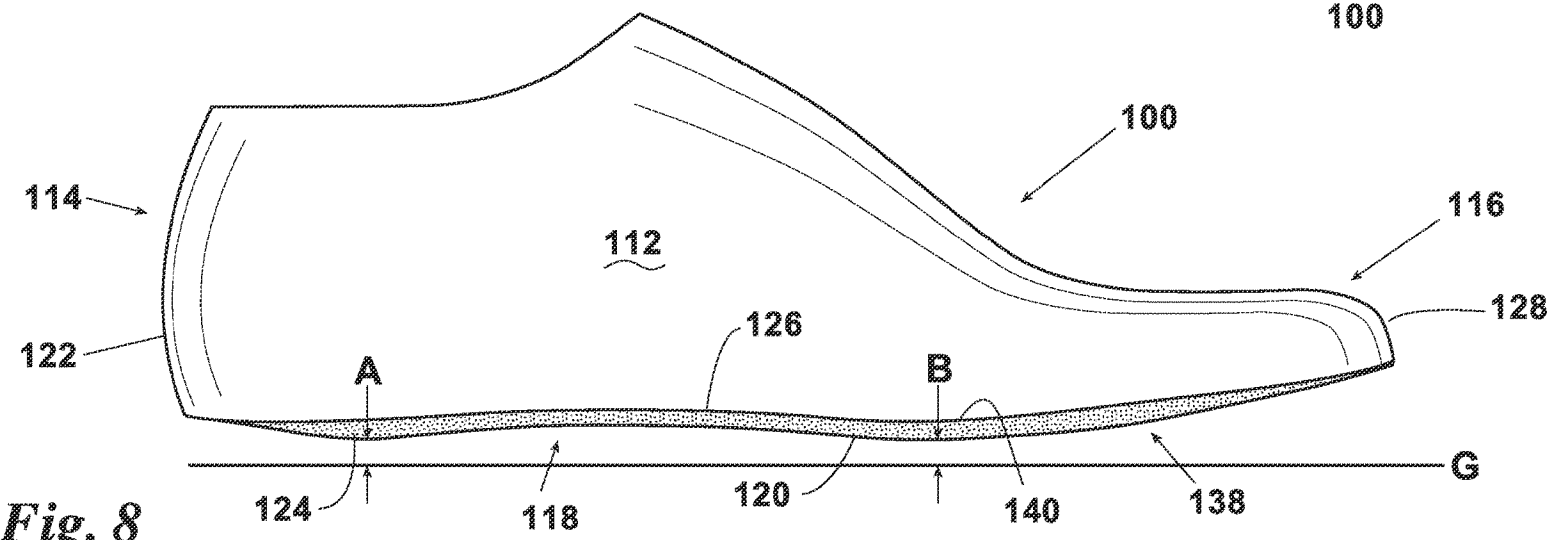
FIG. 8 is an elevation view of a last for building the shoe of FIG. 1.

Referring to FIGS. 8 and 9, last 100 is a mechanical form used by shoemakers in the manufacture and repair of shoes. Last 100 is provided in pairs and may be constructed of various materials, including hardwoods, cast iron, and high-density plastics. Last 100 has a shape similar to that of a human foot. Shoe 10, made from last 100, possesses the same geometry as last 100. Therefore, angles, dimensions, etc., associated with last 100 are attributable to shoe 10 as well.

Still referring to FIGS. 8 and 9, a last 100 for a dress shoe includes a form 112 that approximates a shape of an inside of a shoe to be made from form 112. Form 112 includes a back part 114, a forward part 116 that is divided by a shank or waist 118, and a bottom surface 120.

Back part 114 defines a heel end 122, a seat 124, and an instep 126.

Forward part 116 defines a toe end 128, an inside joint line 130 where inside toe joint will be adjacent to a shoe insole, an outside joint line 132 where an outside toe joint will be adjacent to a shoe insole, a toe edge 134, and an outside 136.

Feathered edge 140 is defined proximate to bottom surface 120 of form 112. Feathered edge 140 runs from toe end 128 to heel end 122.

Shoe 10 is made from shoe last 100 and the shape of shoe 10 is dependent upon the shape of last 100. Last 100 has been designed specifically to mimic the shape of the human foot, disregarding any aesthetics associated with social or fashion norms.

Although particular embodiments have been described herein, it will be appreciated that the invention is not limited thereto and that many modifications and additions thereto may be made within the scope of the invention. For example, various combinations of the features of the following dependent claims can be made with the features of the independent claims without departing from the scope of the present invention.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)–(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A shoe comprising:

a sole having an upper surface, a lower surface, a heel end, and a toe-end, said sole defining a thickness between said upper surface and said lower surface, said sole defining a ball contact area and a heel contacting surface in a heel contact area;

an upper affixed to said upper surface of said sole;

a heel affixed to said lower surface of said sole proximate said heel end of said sole, said heel having a front side, a top surface and a lower side, said top surface defining a sink for receiving said sole proximate said heel end of said sole, wherein a center of said sink in said top surface of said heel is lower than said top surface of said heel adjacent a perimeter of said heel;

a ball contacting surface for supporting a foot of a wearer, said ball contacting surface the same as or adjacent to said upper surface of said sole at said ball contact area;

a heel contacting surface for supporting a foot of a wearer, said heel contacting surface the same as or adjacent to said upper surface of said sole at said heel contact area;

wherein a first thickness of said sole between said ball contacting surface and a said lower surface of said sole in said ball contact area is approximately equal to a second thickness of said sole between said heel contacting surface and a said bottom side of said heel.

2. The shoe according to claim 1 wherein:

said thickness of said sole is said first thickness at said ball contact area and said thickness of said sole is tapered to a different thickness in front of said heel, wherein said first thickness is greater than said different thickness.

3. The shoe according to claim 1 wherein:

said upper surface and said lower surface of said sole define a drop area adjacent to said front side of said heel, said drop area for accommodating a foot of a wearer received in said sink of said heel.

4. The shoe according to claim 1 wherein:

said sink is from 10 mm to 18 mm deep.

5. The shoe according to claim 4 wherein:

said sink is from 12 mm to 15 mm deep.

6. The shoe according to claim 4 wherein:

said sink is approximately 13 mm deep.

7. The shoe according to claim 1 wherein:

said sole further defines an inside surface, an outside surface, an inside joint line, an outside joint line and a longitudinal axis;

wherein a portion of said inside surface of said sole between said inside joint line and said toe-end is parallel to said longitudinal axis for facilitating non-impingement of said upper with a big toe of a wearer.

8. A sole for a shoe comprising:

a heel end, a toe end, and an inside surface, the sole defining a longitudinal axis that bisects said heal end and runs between said heel end and said toe end, said sole defining an inside surface, an upper surface, a lower surface, an outside surface, and an inside joint line;

wherein a portion of said inside surface of said sole between said inside joint line and said toe end is parallel to said longitudinal axis; and wherein said lower surface of said sole defines a downwardly extending drop area adjacent a front side of said heel, said drop area for accommodating a foot of a wearer received in a sink of a heel, said drop area smoothly adjoining a surface in said heel, wherein said drop area for accommodating a foot of a wearer received in a sink of a heel.

9. The sole according to claim 8 wherein the sole is part of a shoe, wherein:

said sole has said upper surface, said lower surface, a ball contact area, a heel contact area, and a thickness between said upper surface and said lower surface;

an upper affixed to said upper surface of said sole;

a heel affixed to said lower surface of said sole proximate said heel end of said sole, said heel having a front side, a perimeter, a top surface and a lower surface, said top surface defining a sink for receiving said sole proximate said heel end of said sole, wherein a center of said sink in said top surface is lower than said top surface adjacent said perimeter of said heel;

a ball contacting surface for supporting a foot of a wearer, said ball contacting surface the same as or adjacent to said upper surface of said sole in said ball contact area;

a heel contacting surface for supporting a foot of a wearer, said heel contacting surface the same as or adjacent to said upper surface of said sole in said heel contact area;

wherein a first thickness of said sole between said ball contacting surface and said lower surface of said sole in said ball contacting area is approximately equal to a second thickness of said sole between said heel contacting surface and a bottom side of said heel.

10. The sole according to claim 9 wherein:

said thickness of said sole is a first thickness at said ball contact area and said thickness of said sole is tapered to a second thickness in front of said heel.

11. The shoe according to claim 8 wherein:

said sink is from 10 mm to 18 mm deep.

12. The shoe according to claim 11 wherein:

said sink is from 12 mm to 15 mm deep.

13. The shoe according to claim 11 wherein:

said sink is approximately 13 mm deep.

14. The shoe according to claim 1 wherein:

said approximately equal thickness is a thickness difference of between-⅛" to ¼", wherein a negative value indicates that the first thickness of said sole between said ball contacting surface and said lower surface is greater than said second thickness of said sole between said heel contacting surface and said bottom side of said heel.

15. The shoe according to claim 14 wherein:

said approximately equal thickness is a thickness difference of between-1/16" to 3/16" wherein a negative value indicates that the first thickness of said sole between said ball contacting surface and said lower surface of said sole is greater than said second thickness of said sole between said heel contacting surface and said bottom side of said heel.

16. The shoe according to claim 15 wherein:

said approximately equal thickness is a thickness difference between 0" to ⅛", wherein a negative value indicates that the first thickness of said sole between said ball contacting surface and said lower surface is greater than said second thickness of said sole between said heel contacting surface and said bottom side of said heel.

17. The shoe according to claim 16 wherein:

said approximately equal thickness is a thickness difference of 0".

18. The shoe according to claim 1 wherein:

said approximately equal thickness is a thickness difference of plus or minus 10%.

* * * * *